US006264301B1

(12) United States Patent
Helterline et al.

(10) Patent No.: US 6,264,301 B1
(45) Date of Patent: Jul. 24, 2001

(54) METHOD AND APPARATUS FOR IDENTIFYING PARAMETERS IN A REPLACEABLE PRINTING COMPONENT

(75) Inventors: Brian L. Helterline, Salem, OR (US); Ronald R. Paulsen, Vancouver; Joseph H. Bauman, Brush Prairie, both of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/076,449

(22) Filed: May 11, 1998

(51) Int. Cl.[7] ..... B41J 29/393
(52) U.S. Cl. ..... 347/19
(58) Field of Search ..... 347/19, 49, 86, 347/87; 399/107, 110, 24

(56) References Cited

U.S. PATENT DOCUMENTS

| | | | | |
|---|---|---|---|---|
| 4,551,000 | | 11/1985 | Kanemitsu et al. | 355/3 R |
| 4,803,521 | | 2/1989 | Honda | 355/14 R |
| 4,961,088 | | 10/1990 | Gilliland et al. | 355/206 |
| 5,021,828 | | 6/1991 | Yamaguchi et al. | 355/209 |
| 5,137,379 | | 8/1992 | Ukai et al. | 400/121 |
| 5,138,344 | | 8/1992 | Ujita | 346/140 R |
| 5,184,181 | | 2/1993 | Kurando et al. | 355/260 |
| 5,272,503 | | 12/1993 | LeSueur et al. | 355/208 |
| 5,363,134 | * | 11/1994 | Barbehenn et al. | 347/19 |
| 5,410,641 | | 4/1995 | Wakabayashi et al. | 395/112 |
| 5,506,611 | * | 4/1996 | Ujita et al. | 347/19 |
| 5,519,422 | * | 5/1996 | Thoman et al. | 347/49 |
| 5,646,660 | | 7/1997 | Murray | 347/59 |
| 5,699,091 | | 12/1997 | Bullock et al. | 347/19 |

FOREIGN PATENT DOCUMENTS

| | | | |
|---|---|---|---|
| 0 812 693 A1 | 12/1997 | (EP) | B41J/2/17 |
| 0 854 044 A2 | 7/1998 | (EP) | B41J/2/175 |
| 0 878 307 A2 | 11/1998 | (EP) | B41J/2/175 |
| 2 744 391 | 8/1997 | (FR) | B41J/2/175 |
| 98/04414 | 2/1998 | (WO) | B41J/2/17 |

* cited by examiner

*Primary Examiner*—John E. Barlow
*Assistant Examiner*—Charles W. Stewart, Jr.
(74) *Attorney, Agent, or Firm*—Kevin B. Sullivan

(57) ABSTRACT

The present disclosure relates to replaceable printing component for an ink-jet printing system having at least one replaceable printing component. The replaceable printing component includes an electrical storage device responsive to printing system control signals for transferring information between the printing component and the ink-jet printing system. The electrical storage device includes a tag family identifier for selecting a family of tags from a plurality of families of tags. Also included is a plurality of tags associated with replaceable consumable parameters. Each of the plurality of tags have a tag value associated therewith. Wherein the ink-jet printing system reads the tag family identifier from the electrical storage device to select the family of tags. Each tag of the plurality of tags read by the ink-jet printer is identified based on the selected family of tags and is used to identify the associated replaceable consumable parameter.

18 Claims, 7 Drawing Sheets

| Address | MSB 7 | 6 | 5 | 4 | 3 | 2 | 1 | LSB 0 |
|---|---|---|---|---|---|---|---|---|
| 0 | TAG $ID_1$ | | | | | DATA LENGTH | | |
| 2 | VALVE 1 | | | | VALUE 2 | ∘ ∘ ∘ | | |
| 3 | VALUE N | | | | | PAD WITH 0'S | | |
| 4 | TAG $ID_2$ | | | | | DATA LENGTH | | |
| 5 | VALUE 1 | | VALUE 2 | | ∘ ∘ ∘ | | | |
| 6 | VALUE N | | | | | | | |
| ∘ ∘ ∘ | ∘ ∘ ∘ | | | | | | | |
| n | | | | | | | | |

FIG. 7

| Byte 1 | | | | | | | | Byte 2 | | | | | | | | Byte 3 | | | | | | | |
|---|---|---|---|---|---|---|---|---|---|---|---|---|---|---|---|---|---|---|---|---|---|---|---|
| 7 | 6 | 5 | 4 | 3 | 2 | 1 | 0 | 7 | 6 | 5 | 4 | 3 | 2 | 1 | 0 | 7 | 6 | 5 | 4 | 3 | 2 | 1 | 0 |
| Last Usage Date | | | | | | | | Insertion Count | | | | | | | | Page Count | | | | | | | |

FIG. 8A

| Byte 1 | | | | | | | | Byte 2 | | | | | | | | Byte 3 | | | | | | | |
|---|---|---|---|---|---|---|---|---|---|---|---|---|---|---|---|---|---|---|---|---|---|---|---|
| 7 | 6 | 5 | 4 | 3 | 2 | 1 | 0 | 7 | 6 | 5 | 4 | 3 | 2 | 1 | 0 | 7 | 6 | 5 | 4 | 3 | 2 | 1 | 0 |
| Last Usage Date | | | | | | | | Page Count | | | | | | | | Insertion Count | | | | | | | |

FIG. 8B

METHOD AND APPARATUS FOR IDENTIFYING PARAMETERS IN A REPLACEABLE PRINTING COMPONENT

BACKGROUND OF THE INVENTION

The present invention relates to ink-jet printing systems that make use of a replaceable printing component. More particularly, the present invention relates to replaceable printing components that include an electrical storage device for providing information to the ink-jet printing system.

Ink-jet printers frequently make use of an ink-jet printhead mounted within a carriage that is moved back and forth across a print media, such as paper. As the printhead is moved across the print media, a control system activates the printhead to deposit or eject ink droplets onto the print media to form images and text. Ink is provided to the printhead by a supply of ink which is either carried by the carriage or mounted to the printing system to not move with the carriage. For the case where the ink supply is not carried with the carriage, the ink supply can be intermittently or continuously connected to the printhead for replenishing the printhead. In either case, the replaceable printing components, such as the ink container and the printhead, require periodic replacement. The ink supply is replaced when exhausted. The printhead is replaced at the end of printhead life.

It is frequently desirable to alter printer parameters concurrently with the replacement of printer components such as discussed in U.S. patent application Ser. No. 08/584,499 entitled "Replaceable Part With Integral Memory For Usage, Calibration And Other Data" assigned to the assignee of the present invention. U.S. patent application Ser. No. 08/584,499 discloses the use of a memory device, which contains parameters relating to the replaceable part. The installation of the replaceable part allows the printer to access the replaceable part parameters to insure high print quality. By incorporating the memory device into the replaceable part and storing replaceable part parameters in the memory device within the replaceable component the printing system can determine these parameters upon installation into the printing system. This automatic updating of printer parameters frees the user from having to update printer parameters each time a replaceable component is newly installed. Automatically updating printer parameters with replaceable component parameters insures high print quality. In addition, this automatic parameter updating tends to ensure the printer is not inadvertently damaged due to improper operation, such as, operating after the supply of ink is exhausted or operation with the wrong or non-compatible printer components.

It is important that the exchange of information between the printer and the replaceable printing component be accomplished in a highly reliable manner. This exchange of information should not require the intervention of the user thereby ensuring greater ease of use and greater reliability. Furthermore, it is important that the integrity of the information be preserved. In the event that the information associated with the replaceable component is corrupted in some manner, it is important that the printer be capable of identifying this data as corrupted. Furthermore, in the event that information is corrupted the printing system should be capable of continuing operation to the extent that print quality is not diminished or the printer is not damaged. Finally, it is important that the printing system have sufficient flexibility to accommodate improvements and additional printer parameters necessary to support these improvements.

SUMMARY OF THE INVENTION

The present disclosure relates to replaceable printing component for an ink-jet printing system having at least one replaceable printing component. The replaceable printing component includes an electrical storage device responsive to printing system control signals for transferring information between the printing component and the ink-jet printing system. The electrical storage device includes a tag family identifier for selecting a family of tags from a plurality of families of tags. Also included is a plurality of tags associated with replaceable consumable parameters. Each of the plurality of tags has a tag value associated therewith. Wherein the ink-jet printing system reads the tag family identifier from the electrical storage device to select the family of tags. Each tag of the plurality of tags read by the ink-jet printer is identified based on the selected family of tags and is used to identify the associated replaceable consumable parameter.

BRIEF DESCRIPTION OF THE DRAWINGS

FIGS. 2A and 2B depicts a schematic representation of the ink-jet printing system shown in FIG. 1 illustrating a removable ink container and printhead each of which contain an electrical storage device of the present invention.

FIG. 7 depicts a parameter tagging technique for identifying parameter values and data organization for the electrical storage device of the present invention.

FIG. 8*a* depicts an arrangement of parameter values according to the technique of the present invention.

FIG. 8*b* depicts an improper arrangement of parameter values.

DETAILED DESCRIPTION OF THE PREFERRED EMBODIMENT

Figure 1:
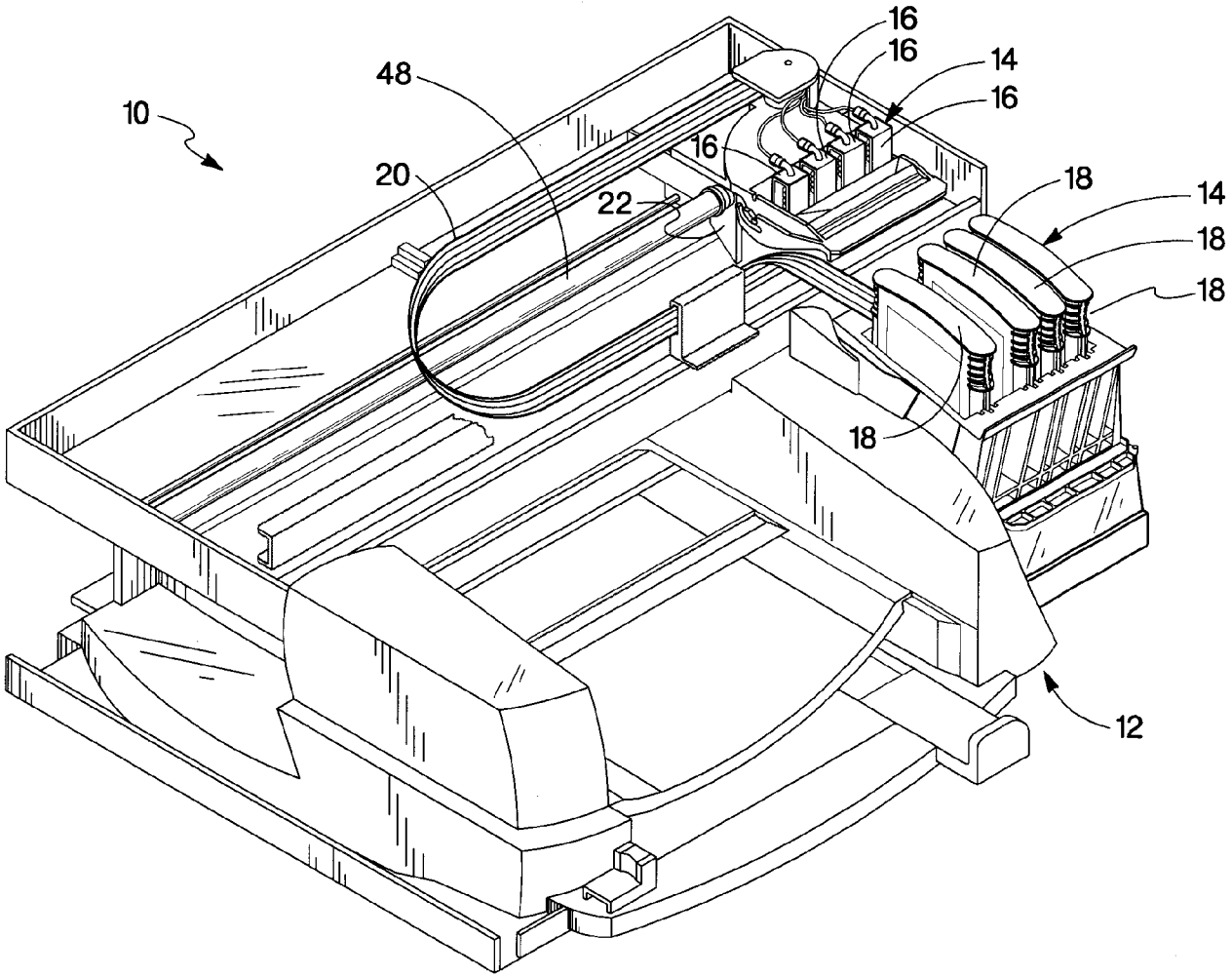
FIG. 1 depicts a perspective view of an exemplary ink-jet printing system, shown with the cover removed, that incorporates removable printing components of the present invention.

FIG. 1 is a perspective view of one exemplary embodiment of an ink-jet printing system 10 of the present invention shown with its cover removed. The ink-jet printing system 10 includes a printer portion 12 having a plurality of replaceable printing components 14 installed therein. The plurality of replaceable printing components 14 include a plurality of printheads 16 for selectively depositing ink in response to control signals and a plurality of ink containers 18 for providing ink to each of the plurality of printheads 16.

Each of the plurality of printheads 16 is fluidically connected to each of the plurality of ink containers 18 by a plurality of flexible conduits 20.

Each of the plurality of printheads 16 is mounted in a scanning carriage 22, which is scanned past a print media (not shown) as the print media is stepped through a print zone. As the plurality of printheads are moved relative to the print media, ink is selectively ejected from a plurality of orifices in each of the plurality of the printheads 16 to form images and text.

One aspect of the present invention is a method and apparatus for storing information on the replaceable printing components 14 for updating operation parameters of the printer portion 12. An electrical storage device is associated with each of the replaceable printing components 14. The electrical storage device contains information related to the particular replaceable printer component 14. Installation of the replaceable printing component 14 into the printer portion 12 allows information to be transferred between the electrical storage device and the printing portion 12 to insure high print quality as well as to prevent the installation of non-compatible replaceable printing components 14. The information provided from the replaceable printing component 14 to the printing portion 12 tends to prevent operation of the printing system 10 in a manner which damages the printing system 10 or which reduces the print quality.

Although the printing system 10 shown in FIG. 1 makes use of ink containers 18 which are mounted off of the scanning carriage 22, the present invention is equally well suited for other types of printing system configurations. One such configuration is one where the replaceable ink containers 18 are mounted on the scanning carriage 22. Alternatively, the printhead 16 and the ink container 18 may be incorporated into an integrated printing cartridge that is mounted to the scanning carriage 22. Finally, the printing system 10 may be used in a wide variety of applications such as facsimile machines, postal franking machines, copiers and large format type printing systems suitable for use in displays and outdoor signage.

Figure 2A:
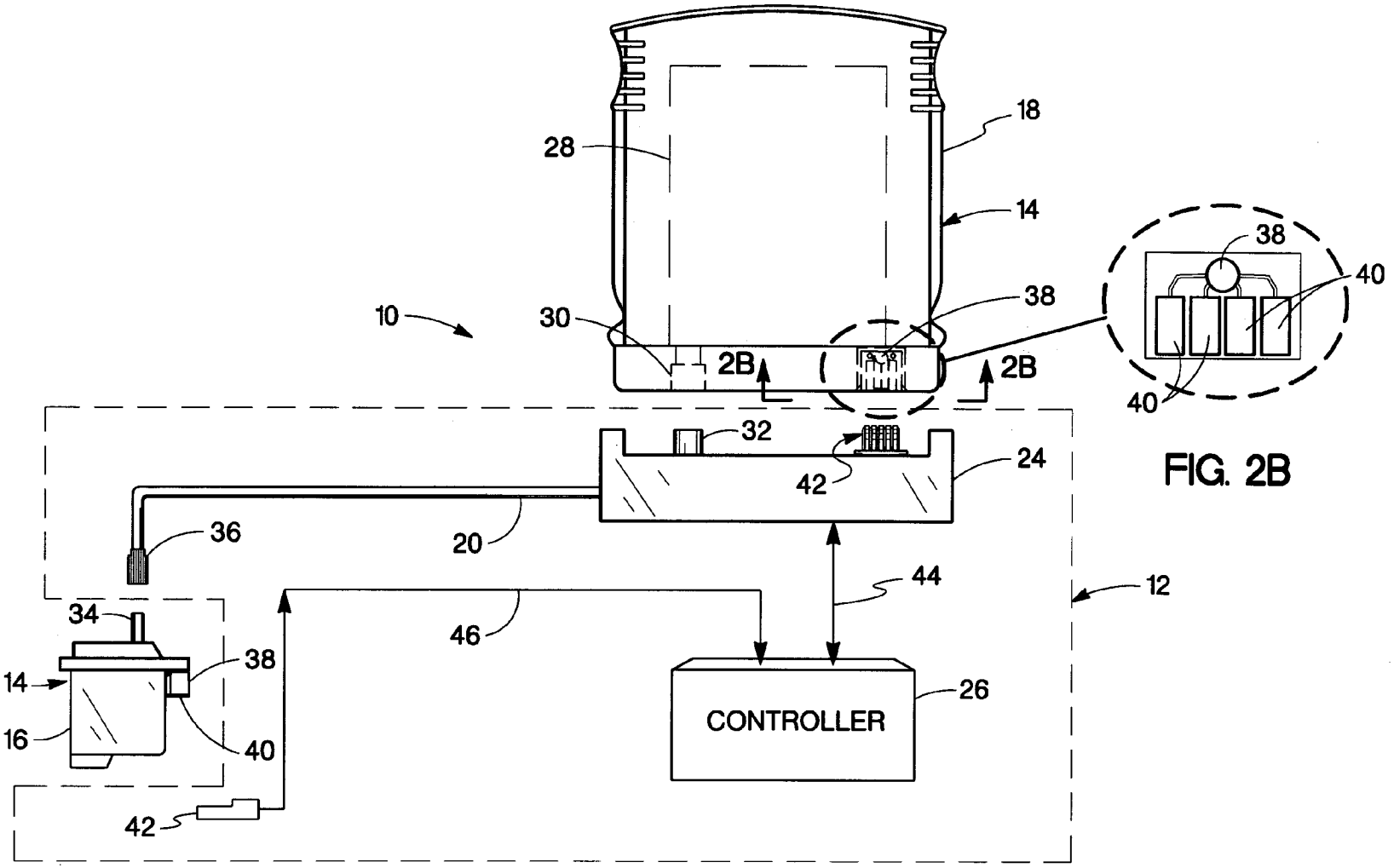

FIGS. 2A and 2B depict a simplified schematic representation of the ink-jet printing system 10 of the present invention shown in FIG. 1. FIGS. 2A and 2B are simplified to illustrate a single printhead 16 and a single ink container 18 for accomplishing the printing of a single color. For the case where more than one color is desired a plurality of printheads 16 are typically used each having an associated ink container 18 as shown in FIG. 1.

The ink-jet printing system 10 of the present invention includes a printer portion 12 having replaceable printing components 14. The replaceable printing components 14 include a printhead 16 and an ink container 18. The printer portion 12 includes an ink container receiving station 24 and a controller 26. With the ink container 18 properly inserted into the ink container receiving station 24, an electrical and a fluidic coupling is established between the ink container 18 and the printer portion 12. The fluidic coupling allows ink stored within the ink container 18 to be provided to the printhead 16. The electrical coupling allows information to be passed between the ink container 18 and the printer portion 12 to ensure the operation of the printer portion 12 is compatible with the ink contained in the ink container 18 thereby achieving high print quality and reliable operation of the printing system 10.

The controller 26 controls the transfer of information between the printer portion 12 and the ink container 18. In addition, the controller 26 controls the transfer of information between the printhead 16 and the controller 26. Finally, the controller 26 controls the relative movement of the printhead 16 and the print media as well as selectively activating the printhead to deposit ink on print media.

The ink container 18 includes a reservoir 28 for storing ink therein. A fluid outlet 30 is provided that it is in fluid communication with the fluid reservoir 28. The fluid outlet 30 is configured for connection to a complimentary fluid inlet 32 associated with the ink container receiving station 24.

The printhead 16 includes a fluid inlet 34 configured for connection to a complimentary fluid outlet 36 associated with the printing portion 12. With the printhead 16 properly inserted into the scanning carriage 22 (shown in FIG. 1) fluid communication is established between the printhead and the ink container 18 by way of the flexible fluid conduit 20.

Each of the replaceable printing components 14 such as the printhead 16 and the ink container 18 include an information storage device 38 such as an electrical storage device or memory 38 for storing information related to the respective replaceable printer component 14. A plurality of electrical contacts 40 are provided, each of which is electrically connected to the electrical storage device 38. With the ink container 18 properly inserted into the ink container receiving station 24, each of the plurality of electrical contacts 40 engage a corresponding plurality of electrical contacts 42 associated with the ink container receiving station 24. Each of the plurality of electrical contacts 42 associated with the ink container receiving station 24 are electrically connected to the controller 26 by a plurality of electrical conductors 44. With proper insertion of the ink container 18 into the ink container receiving station 24, the memory 38 associated with the ink container 18 is electrically connected to the controller 26 allowing information to be transferred between the ink container 18 and the printer portion 12.

Similarly, the printhead 16 includes an information storage device 38 such as an electrical storage device associated therewith. A plurality of electrical contacts 40 are electrically connected to the electrical storage 38 in a manner similar to the electrical storage device 38 associated with the ink container 18. With the printhead 16 properly inserted into the scanning carriage 22 the plurality of electrically contacts 40 engage a corresponding plurality of electrical contacts 42 associated with the printing device 12. Once properly inserted into the scanning carriage, the electrical storage device 38 associated with the printhead 16 is electrically connected to the controller 26 by way of a plurality of electrical conductors 46.

Although electrical storage devices 38 associated with each of the ink container 18 and the printhead 16 are given the same element number to indicate these devices are similar, the information stored in the electrical storage device 38 associated with the ink container 18 will, in general, be different from the information stored in the electrical storage device 38 associated with the printhead 16. Similarly, the information stored in electrical storage device 38 associated with each ink container of the plurality of ink containers 18 will in general be different and unique to the particular ink container of the plurality of ink containers 18. The particular information stored on each electrical storage device 38 will be discussed in more detail later.

Figure 3:
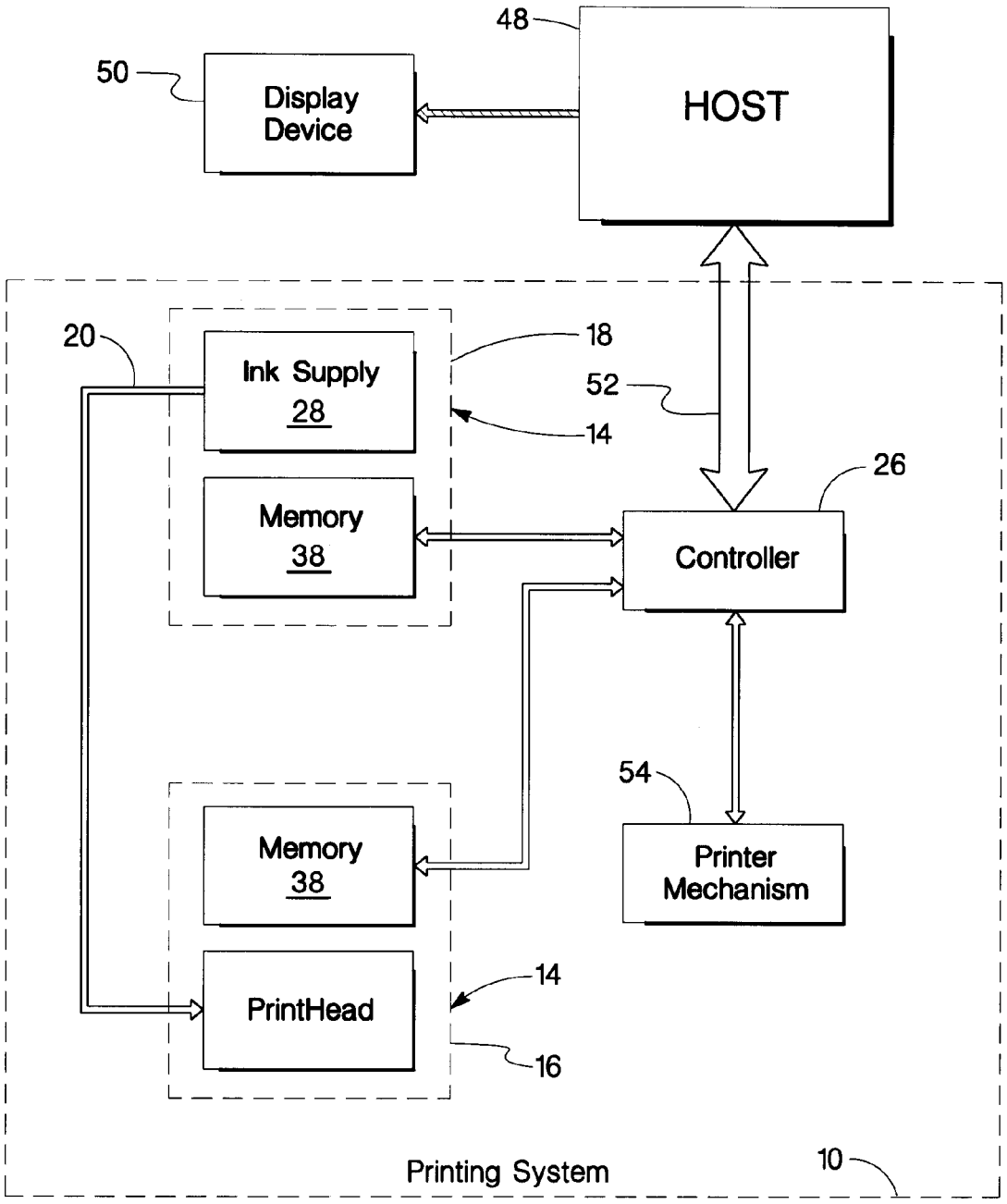
FIG. 3 depicts a schematic block diagram of the ink-jet printing system of FIG. 1 shown connected to a host and which includes a removable ink container and printhead each of which contain the electrical storage device of the present invention.

FIG. 3 represents a block diagram of the printing system 10 of the present invention shown connected to an information source or host computer 48. The host computer 48 is shown connected to a display device 50. The host 48 can be a variety of information sources such as a personal computer, work station, or server to name a few, that provides image information to the controller 26 by way of a data link 52. The data link 52 may be any one of a variety of conventional data links such as an electrical link or an infrared link for transferring information between the host 48 and the printing system 10.

The controller 26 is electrically linked to the electrical storage devices 38 associated with each of the printhead 16 and the ink container 18. In addition, the controller 26 is electrically linked to a printer mechanism 54 for controlling media transport and movement of the carriage 22. This link may be a variety of different linkages such as electrical or optical linkage that supports information transfer. The controller 26 makes use of parameters and information provided by the host 48, the memory 38 associated with the ink container 18 and memory 38 associated with the printhead 16 to accomplish printing.

The host computer 48 provides image description information or image data to the printing system 10 for forming images on print media. In addition, the host computer 48 provides various parameters for controlling operation of the printing system 10, which is typically resident in printer control software typically referred to as the "print driver". In order to ensure the printing system 10 provides the highest quality images it is necessary that the operation of the controller 26 compensate for the particular replaceable printer component 14 installed within the printing system 10. It is the electric storage device 38 that is associated with each replaceable printer component 14 that provides parameters particular to the replaceable printer component 14 that allows the controller 26 to utilize these parameters to ensure the reliable operation of the printing system 10 and insure high quality print images.

Among the parameters, for example which can be stored in electrical storage device 38 associated with the replaceable printing component 14 are the following: actual count of ink drops emitted from the printhead 16; a date code associated with the ink container 18; date code of initial insertion of the ink container 18; system coefficients; ink type/color: ink container size; age of the ink; printer model number or identification number; cartridge usage information; just to name a few.

Figure 4:
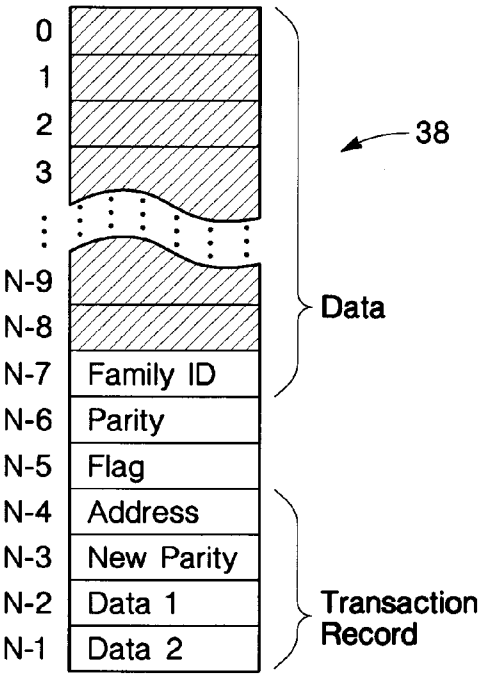
FIG. 4 depicts a representation of the electrical storage device of the present invention illustrating a data portion and a transaction record portion.

FIG. 4 is a representation of the memory device 38 that is used in conjunction with the controller 26 of the printing system 10 for ensuring data integrity for data transfers between the memory device 38 and the controller 26. The memory device 38 is organized as an 8 bit by N memory where N represents the size of the memory device. Each individually addressable 8 bit memory location is represented by a range of address values from 0 to N−1. Although FIG. 4 is used is to illustrate some of the information stored in the memory device 38, the memory device 38 may contain additional information not discussed. In addition, the location of the information in the memory device 38 may be different from those locations shown in FIG. 4. It is important that the controller 26 in the printing system 10 know where at least some of the particular information is stored.

The memory device 38 includes a portion for storing data and a portion for storing a transaction record. The data portion contains various data that is related to the replaceable printing component 14. The transaction record maintains a record of each transaction between the memory device 38 and the controller 26. In the event that a transaction is interrupted before completion the transaction record can be used to restore the data lost in the interrupted transaction. Because the transaction record is retained in the replaceable printing component 14 then the data lost in the last transaction can be restored even if the replaceable printing component 14 is inserted into a different printing system. In the event the transaction is interrupted by a loss of power, once the power is restored the last transaction can be restored. In this manner, data integrity for the replaceable printing component 14 is maintained.

Memory address values 0 through N−7 contains data that includes various parameters relating to the replaceable printing component 14 and tag information. The tag information is used for identifying these various parameters and will be discussed with respect to FIG. 7.

Memory address values N−4 through N−1 contain transaction record information. It is the use of the transaction technique of the present invention that ensures data transactions between the controller 26 and the memory 38 if corrupted can be corrected to insure the integrity of data transfer between the printer 10 and the replaceable printing component 14. Because data transfers between the controller 26 and the memory device 38 may be interrupted; it is critical that some technique be used to insure data integrity. For example, in the case where the replaceable printing component 14 is the ink container 18, it is possible to remove the ink container 18 while the controller 26 is transferring data to the memory 38. If this data transfer is interrupted and data is lost then the integrity of the data is compromised. It is therefore important that there be some way of identifying when a data transaction between the controller 26 and the printing system 10 and the replaceable printing component 14 is not properly accomplished. If a transaction is not properly accomplished the transaction record provides a mechanism to recover this data that was lost in the interrupted transaction to preserve data integrity within the printing system 10.

In addition to the data portion represented by address values 0 through N−7 and the transaction record portion represented by address values N−4 through N−1 there are several additional values that are stored in memory device 38 that will be discussed specifically. Memory address value N−7 contains family identification information, memory address value N−6 contains parity information and memory address value N−5 contains flag information. The family identification information will be discussed in more detail with respect to FIG. 7.

It is the parity information, the flag information, and the transaction record which are used together to preserve the integrity of data transfers between the controller 26 and the memory 38. The transaction record portion includes an address byte, a new parity byte, two bytes of data designated data byte 1 and data byte 2. The transaction record portion stores data that is subsequently written by the printing system 10 to the data portion. If the subsequent write to the data portion is interrupted, the transaction record is used to restore the contents of this interrupted data write. It will be helpful to first discuss the transaction record portion in more detail before explaining the technique of the present invention for preserving data integrity.

The address portion of the transaction record portion contains the address value of the first byte of data to be subsequently written into the data portion during a write transaction. The address value acts as a pointer that points to the memory address that is to be altered by the subsequent data write. The data byte 1 represents the data value that is to be written in the subsequent write transaction. Data byte 2 represents the data value that is to be written to the next sequential address following the address corresponding to data byte 1. Therefore, the subsequent write transaction writes the value of data byte 1 to the address value of the pointer stored in the transaction record. The subsequent write transaction also writes the value of data byte 2 to the next sequential memory address value from the memory address value. Therefore, data byte 1 is placed in the address of the pointer and data byte 2 is placed in the address of the pointer plus one.

The new parity value within the transaction record portion represents a parity value to replace the parity byte in address N−6 after data byte 1 and data byte 2 are used to replace data in the data portion. The new parity value is determined by performing a parity function over the entire data area, and the contents of the transaction record portion so that after data in the data portion is replaced within data byte 1 and data byte 2 the parity is correct. Therefore, in the event of data loss during a transaction the data and parity is restored placing the memory in the same condition it would be in if the transaction was not interrupted.

The flag information stored in address value N−5 contains a flag value which indicates the state of the transaction record. One flag value is used to indicate that the transaction record is "busy" representing that new valid data has been recorded in the transaction record. Another flag value is used to indicate that the transaction record is "not busy" representing that either data is not valid in the transaction record or the data in the transaction record is not new data.

Figure 6:
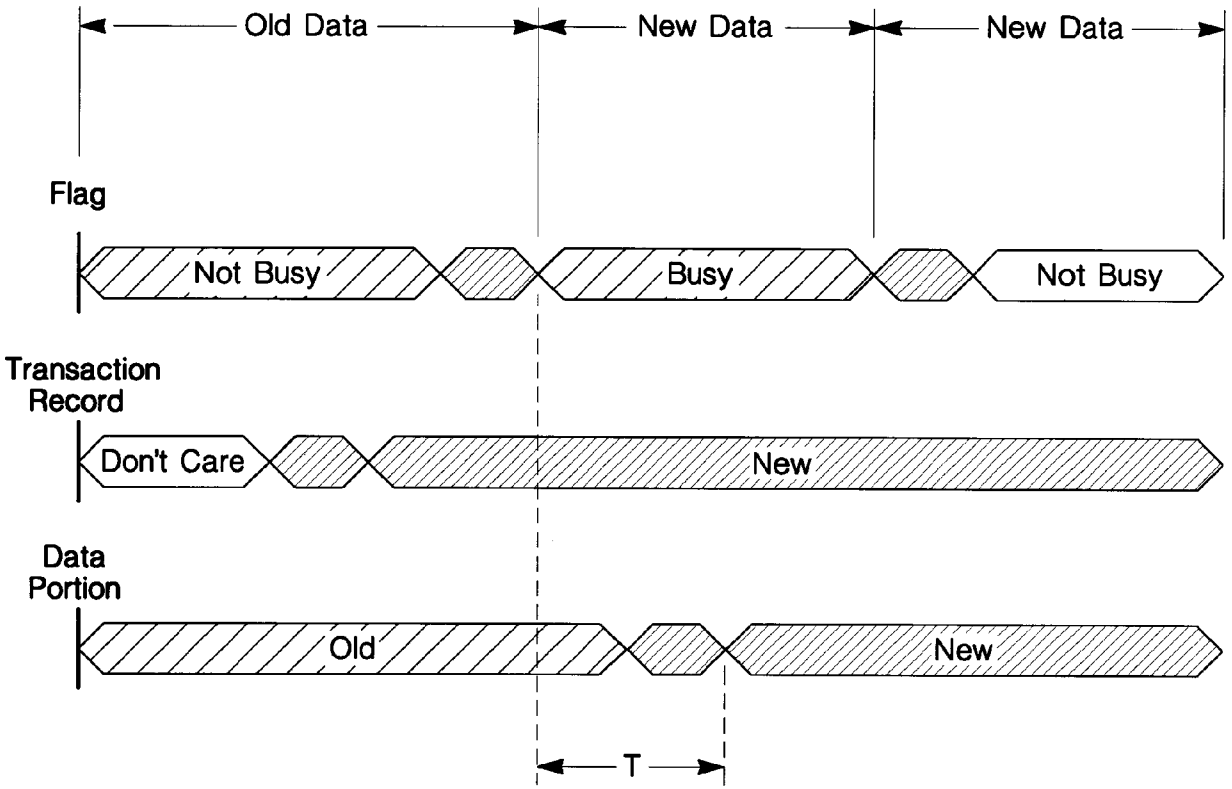
FIG. 6 depicts a representation of a timing diagram illustrating a data transaction between the ink-jet printing system and a replaceable printing component.
Figure 5:
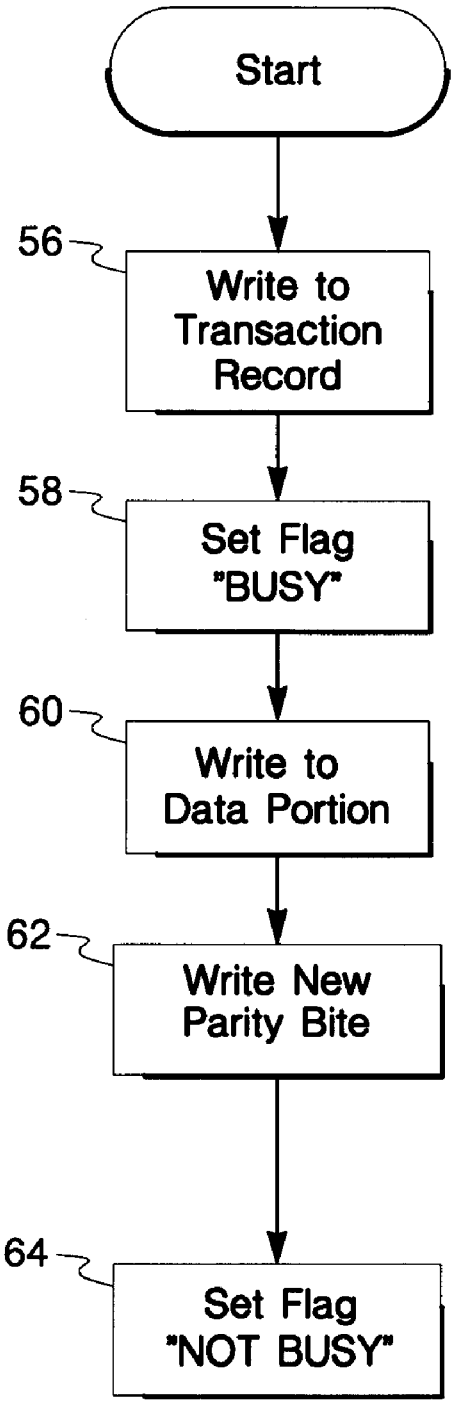
FIG. 5 depicts a method of the present invention for transferring data between the ink-jet printing system and a replaceable printing component.

FIG. 5 and FIG. 6 will be used to illustrate the write transaction technique for preventing the corruption of data in the event the data transaction is interrupted. Data transfers from the printing system 10 to the replaceable printing component 14 are accomplished by the controller 26 which transfers data to memory 38. This data transfer involves first writing to the transaction record in memory 38 as represented by step 56 in FIG. 5. Writing to the transaction record includes writing up to two data bytes, the address byte or pointer and a new parity value to the transaction record portion of memory 38 as shown in FIG. 4. The flag value stored in address value N−5 is updated to indicate that the transaction record has new or valid data as represented by step 58. In addition, the flag indicates that the write operation to the transaction record was accomplished successfully. Next, data is written to the data portion represented by address values 0 through N−7 of the memory 38 as shown in step 60. A new parity byte is written to the parity location value N−6 as represented by step 62. The flag is then set to "not busy" as represented by step 64.

Each write operation represented by steps 56, 58, 60, 62 and 64 in FIG. 5 is verified by the printing system 10. If write operation is not completed the write operation is repeated and again verified. If after a predetermined number of retries are attempted without verification of the write operation then the replaceable printing component 14 is defective.

If a write operation represented by steps 56, 58, 60, 62, and 64 is interrupted such as by the removal of the replaceable printing component 14 or a loss of power occurs then the printing system 10 can recover. If the write to the transaction record has not been completed then the printing system 10 can repeat this write operation. If the write to the data portion or the write to the parity byte is not completed then these values are restored using values from the transaction record.

FIG. 6 represents a simplified timing diagram of the write transaction method as discussed with respect to FIG. 5. The timing diagram represents the state of each of the flag portion, and data portion of memory 38. Interruptions in the transaction process that occur after the busy flag has been set but prior to the new data arriving to the data portion as represented by time T as shown in FIG. 6 can be recovered from the transaction record.

FIG. 7 represents the data organization of data in memory device 38. One aspect of the present invention is the organization of data in the memory device 38 that ensures the integrity of data in the event that a single write transaction is corrupted. It is important that parameter values associated with the replaceable printing component 14 be sized and organized properly such that in the event that the sequence of transactions is interrupted, a parameter is not partially updated. This technique ensures that the replaceable printing component parameters are either updated completely or not updated at all. In the event that these parameters are not updated due to an interruption of the single transaction, then that transaction can be recovered using the transaction record to update those parameters completely. If data were corrupted without a means for recovering the integrity of the system would be compromised.

As discussed previously the memory device 38 is organized in bytes of data with each data byte containing eight individual bits of information. These bits of information are labeled values 0–7 in FIG. 7 with 0 being the least significant bit and bit 7 being the most significant bit. Each individual byte of data is addressable as represented by address values from 0–N in FIG. 7.

A tagging scheme is used to identify or label stored data. The use of a tagging scheme provides greater flexibility in organizing data in the memory device 38. The use of a tagging scheme allows greater flexibility in the location and size of data within the memory device 38. In addition, the tagging scheme allows for new data values to be added for adding new features and improvements to the printing system while allowing for downward compatibility. For example, the replaceable printing component 14 may include data for providing a particular feature for new printers. Older printers that do not have that feature can still make use of the replaceable printing component 14 by simply ignoring the data associated with tags that the older printing system does not recognize. In this manner, number of versions of the replaceable printing component 14 is reduced, tending to reduce manufacturing costs of the replaceable printing component 14.

The tagging scheme makes use of tag identifiers (IDs) that are selectively positioned in the data portion of memory device 38 to identify data parameters or data fields that are associated with each tag ID. In the preferred embodiment, the tag ID's are a 5-bit values identifying the data parameter values that follow. In addition to the tag ID a data length parameter is provided to identify the size of the data parameters associated with the tag ID. In the preferred embodiment, the data length parameter is a 3-bit value that identifies the number of bytes from 0 to 7 that follow. Therefore, if a particular tag is not recognized the printing system uses the data length value to determine where the next tag resides in the memory device 38. This next tag is then read in to determine if this tag is recognized. If the tag is recognized, then the parameter values associated with that tag can be read in by the printing system 10.

In the preferred embodiment, each tag ID is located on a byte boundary. Therefore, when reading the next tag ID it will always begin on the byte boundary. The parameter values associated with the tag ID do not have to start on byte boundaries. It is important that each parameter stored in the replaceable printing component 14 be updated in a single transaction to insure data integrity. FIGS. 8A and 8B illustrate how the parameter values are sized and arranged to insure data integrity in the memory device 38. In the example shown in FIGS. 8A and 8B the tag ID identifies that the parameter values which follow are a 10 bit last usage date value, a 6 bit insertion count value, and an 8 bit page count value. Each of these parameter values are transferred between the printer and the replaceable printing component 14 using the write transaction technique previously discussed. The data is transferred two bytes at a time with the first transaction sends byte 1 and byte 2 which includes the last usage date parameter and the insertion count parameter and a second transaction sending byte 3 which includes the page count parameter. If either the first or second transaction is interrupted, no parameter values are partially updated because the parameters do not span more than one transaction.

In contrast, if the parameter values were sized and arranged such that the tag identifier indicated that the parameters were in a different order as shown in FIG. 8*b* then a different result occurs. For the case where the data values include a 10 bit last usage value, an 8 bit page count value then these values or parameters span more than one transaction between the replaceable printing component 14 and the printer. The page count parameter spans between byte 2 that is part of one transaction and byte 3 that is part of a different transaction. Therefore, 6 bits of the page count would be transmitted in one transaction and 2 bits of the page count together with insertion count would be transmitted on the second transaction. If the system would be interrupted at any time, the value of the page count parameter may be only partially updated and therefore provide an inaccurate value. It is essential that the parameter values not span more than one transaction to insure the integrity of the data in the printing system 10.

The groupings of data bytes for each transaction can vary. It is important that whatever the grouping of data bytes that both the controller 26 and the memory device 38 both use the selected grouping. For example, in page mode 4 bytes of data are transferred for each transaction. The controller 26 requests data parameters in a specified order and the data parameters are sized and positioned so that no data parameter spans more than one transaction.

Figure 9:
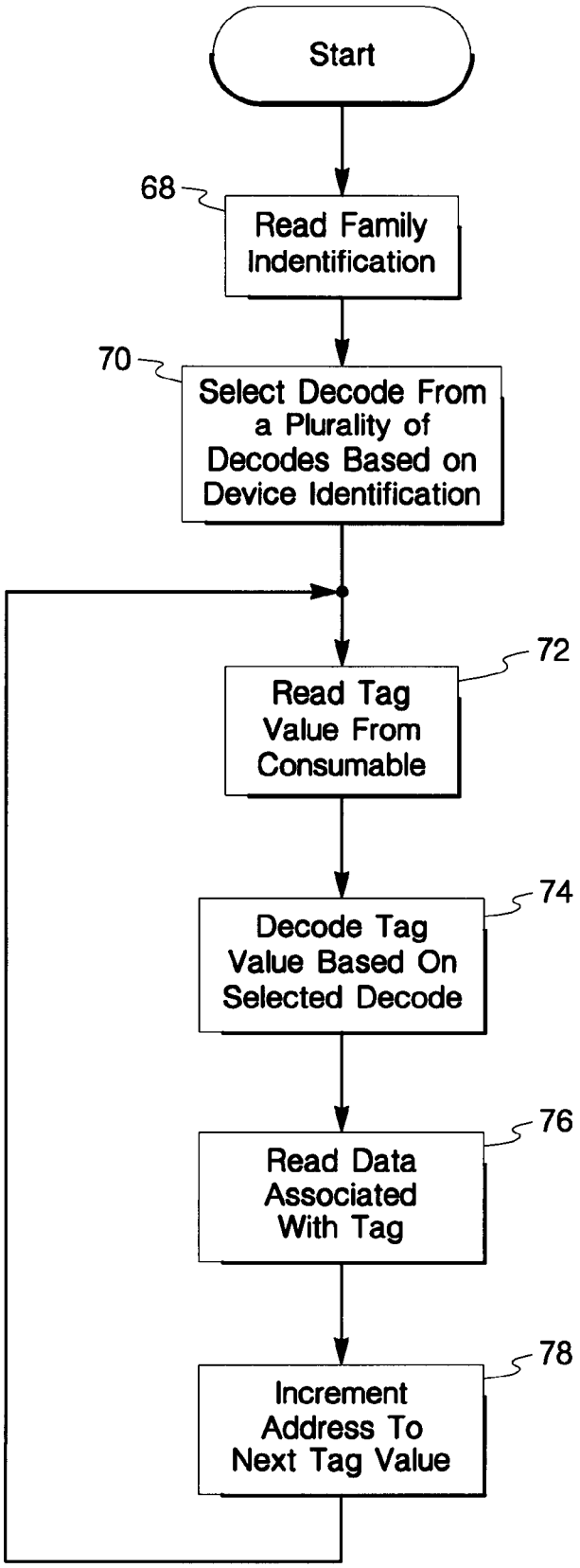
FIG. 9 depicts a method of reading replaceable printing component parameter values from the replaceable printing component.

FIG. 9 depicts a method for reducing the size or number of bits required for the tag ID. Because the tag ID consumes space in the memory 38 as well as requires overhead in the transactions between the printing system 10 and the replaceable printing component 14 it is beneficial to reduce the size of the tag ID.

A family ID is provided with each memory device 38 as shown in FIG. 4. The family ID is shown in address value N−7 only for illustrative purposes. The family ID in general will be in a memory location that is known to the printer control electronics 26. In the preferred embodiment the family ID is a 5-bit value that identifies the particular family of replaceable printing component 14. The printing system 10 uses this family ID to interpret the tag ID. This may be implemented by using a plurality of different Decodes with each Decode unique to a particular family ID. The printing system 10 selects the proper Decode based on family ID and then uses this Decode to decode or interpret each tag ID associated with that family.

In operation, the printing system 10 reads the family ID from the memory 38 as represented by step 68. As represented by step 70 the printing system then selects the proper Decode from a plurality of different Decodes based on the family ID read in step 68. The printer then reads the memory device 38 until it recognizes a tag ID value as represented by step 72. This tag ID is decoded based on the Decode selected in step 70. The Decoded tag ID identifies the data that follows the tag as represented by step 74. This data is then read by the printing system 10 as represented by step 76. The printing system 10 then jumps to the next tag ID as represented step 78 and reads this tag ID as represented by step 72. This process continues until all of the tags and associated parameters have been read into the printing system.

In the case where the printing system 10 includes a plurality of replaceable printing components 14 as shown in FIG. 1, if each replaceable printing component parameter value required a unique tag ID, the tag ID field size would be very large if a separate family Decode for each family type was not used. This large tag ID would consume significantly more memory as well as require greater overhead in the transactions with the printing device. Therefore, there is a significant saving by providing a family ID and then interpreting the tag IDs based on this family ID.

Although the present invention has been described with respect to the preferred embodiment where the replaceable printing components 14 are the printhead portion 16 mounted on the print carriage 22 and the ink container 18 mounted in the receiving station 24 the present invention is suited for other printer configurations as well. For example, the printhead portion and the ink container portion may each be mounted on the printing carriage 22. For this configuration each of the printhead portion and the ink container portion are separately replaceable. Each of the printhead portion and the ink container includes an electrical storage portion 38 for providing information to the printing portion 12. Each of the ink containers of a plurality of ink containers may be separately replaceable or replaceable as an integrated unit. For the case where the plurality of ink containers is integrated into a single replaceable printing component 14 then only a single electrical storage portion 38 may be required for this single replaceable printing component 14.

What is claimed is:

1. A replaceable printing component for an ink-jet printing system having at least one replaceable printing component, the replaceable printing component comprising:

an electrical storage device responsive to printing system control signals for transferring information between the printing component and the ink-jet printing system, the electrical storage device including:

a tag family identifier identifying a family of tags of a plurality of families of tags; and a plurality of tags within the family of tags, each tag of the plurality of tags is associated with a replaceable consumable parameter, with each tag of the plurality of tags having a tag value associated therewith, wherein the ink-jet printing system reads the tag family identifier from the electrical storage device to select the family of tags, each tag of the plurality of tags read by the ink-jet printer is identified based on the selected family of tags and is used to identify the associated replaceable consumable parameter.

2. The replaceable printing component of claim 1 wherein the tag family identifier is a 5 bit value that uniquely identifies the family of tags from the plurality of families of tags.

3. The replaceable printing component of claim 1 wherein each tag of the plurality of tags includes a parameter identifier portion and a size portion.

4. The replaceable printing component of claim 1 wherein the replaceable printing component is a replaceable ink-jet printhead, the replaceable ink-jet printhead responsive to control signals for selectively depositing ink on print media and wherein the tag family identifier corresponds with the replaceable ink-jet printhead.

5. The replaceable printing component of claim 1 wherein the replaceable printing component is a replaceable ink container containing a quantity of ink, the replaceable ink container providing ink to the ink-jet printing system and wherein the tag family identifier corresponds with the replaceable ink container.

6. A method for storing information on an electrical storage device, the electrical storage device for use with a replaceable consumable for an ink-jet printing system, the method comprising:

storing a family identification value on the electrical storage device, the family identification value indicative of a particular replaceable consumable of a plurality of different replaceable consumables; and storing a plurality of parameter identifiers on the electrical storage device, the plurality of parameter identifiers identifying data contained in the electrical storage device, the plurality of parameter identifiers selected based on the family identification value.

7. The method for storing information on an electrical storage device of claim 6 wherein before storing the family identification value the method includes determining the family identification value based on the particular replaceable consumable.

8. The method for storing information on an electrical storage device of claim 6 wherein the family identification value is a 5-bit value.

9. The method for storing information on an electrical storage device of claim 6 wherein each parameter identifier of the plurality of parameter identifiers specifies a parameter stored in the electrical storage device of the replaceable consumable.

10. An ink-jet printing system for selectively depositing ink on print media, the ink-jet printing system comprising:

a replaceable printing component having an electrical storage device associated therewith, the electrical storage device having a family identifier, a plurality of tags and a plurality of parameters stored therein, with the family identifier selected from a plurality of family identifiers based on the replaceable printing component the plurality of tags and the plurality of parameters associated with the replaceable printing component; and a printer portion for receiving the replaceable printing component, the printer portion reading the family identifier and each of the plurality of tags, the printer portion determining a parameter identification from a plurality of parameter identifications based on the family identifier.

11. The ink-jet printing system of claim 10 wherein the replaceable printing component is a replaceable ink-jet printhead, the replaceable ink-jet printhead responsive to control signals for selectively depositing ink on print media and wherein the family identifier corresponds with the replaceable ink-jet printhead.

12. The ink-jet printing system of claim 10 wherein the replaceable printing component is a replaceable ink container containing a quantity of ink, the replaceable ink container providing ink to the ink-jet printing system and wherein the family identifier corresponds with the replaceable ink container.

13. The ink-jet printing system of claim 10 wherein the family identifier is a 5-bit value that identifies the replaceable printing component from a plurality of replaceable printing components.

14. A method for reading parameters from a replaceable printing component, the replaceable printing component insertable into an ink-jet printing system for transferring information between an electrical storage device of the replaceable printing component and the ink-jet printing system, the method comprising:

reading a tag family identifier, a tag and a parameter value associated with the tag from the electrical storage device of the replaceable printing component; and determining a tag parameter from a plurality of tag parameters based on the tag family identifier, the tag parameter having a value corresponding to the parameter value.

15. The method for reading parameters from the replaceable printing component of claim 14 further including storing the parameter value in a location based on the tag parameter.

16. The method for reading parameters from the replaceable printing component of claim 14 wherein the replaceable printing component is a replaceable ink-jet printhead, the replaceable ink-jet printhead responsive to control signals for selectively depositing ink on print media and wherein the tag family identifier corresponds with the replaceable ink-jet printhead.

17. The method for reading parameters from the replaceable printing component of claim 14 wherein the replaceable printing component is a replaceable ink container containing a quantity of ink, the replaceable ink container providing ink to the ink-jet printing system and wherein the tag family identifier corresponds with the replaceable ink container.

18. The method for reading parameters from the replaceable printing component of claim 14 wherein the tag family identifier is a 5-bit value that identifies the replaceable printing component from a plurality of replaceable printing components.

* * * * *